US010433593B1

(12) United States Patent
DiIanni et al.

(10) Patent No.: US 10,433,593 B1
(45) Date of Patent: Oct. 8, 2019

(54) FLAME RESISTANT FABRIC AND GARMENT

(75) Inventors: William J. DiIanni, Kernersville, NC (US); Weidong Wu, Chapel Hill, NC (US); E. Keith Adams, Asheboro, NC (US)

(73) Assignee: Elevate Textiles, Inc., Greensboro, NC (US)

( * ) Notice: Subject to any disclaimer, the term of this patent is extended or adjusted under 35 U.S.C. 154(b) by 407 days.

(21) Appl. No.: 12/860,548

(22) Filed: Aug. 20, 2010

Related U.S. Application Data

(60) Provisional application No. 61/235,911, filed on Aug. 21, 2009.

(51) Int. Cl.

| | |
|---|---|
| ***A41D 13/00*** | (2006.01) |
| ***A41D 3/02*** | (2006.01) |
| ***A41D 27/02*** | (2006.01) |
| ***A41D 1/02*** | (2006.01) |

(52) U.S. Cl.
CPC ..... *A41D 13/00* (2013.01); *A41D 1/02* (2013.01); *A41D 3/02* (2013.01); *A41D 27/02* (2013.01)

(58) Field of Classification Search
None
See application file for complete search history.

(56) References Cited

U.S. PATENT DOCUMENTS

| | | | | |
|---|---|---|---|---|
| 2,939,200 A | | 6/1960 | Ewing et al. | |
| 3,558,267 A | | 1/1971 | Langenfeld | |
| 3,628,995 A | | 12/1971 | Economy et al. | |
| 3,852,947 A | * | 12/1974 | Mayer | 57/245 |
| 3,855,356 A | | 12/1974 | Luce | |
| 3,875,108 A | * | 4/1975 | Koch et al. | 524/141 |
| 3,877,974 A | | 4/1975 | Mischutin | |
| 3,918,901 A | | 11/1975 | Ida et al. | |
| 3,954,400 A | * | 5/1976 | Reeves et al. | 8/192 |
| 3,974,310 A | | 8/1976 | Mischutin | |
| 3,997,699 A | * | 12/1976 | Sistrunk | 442/142 |
| 4,001,477 A | | 1/1977 | Economy et al. | |
| 4,083,818 A | * | 4/1978 | Brackenridge | 521/108 |
| 4,086,208 A | * | 4/1978 | Murayama et al. | 528/167 |
| 4,095,940 A | * | 6/1978 | Weingarten | 8/483 |

(Continued)

FOREIGN PATENT DOCUMENTS

| | | |
|---|---|---|
| EP | 0 111 124 | 6/1984 |
| EP | 0 159 876 A2 | 10/1985 |

(Continued)

OTHER PUBLICATIONS businessdictionary.com, Dec. 19, 2007.*

(Continued)

*Primary Examiner* — Chinessa T. Golden
(74) *Attorney, Agent, or Firm* — Dority & Manning, P.A.

(57) ABSTRACT

A flame resistant fabric is formed from synthetic fibers, such as polyester fibers or non-aramid polyamide fibers. A first flame retardant is incorporated into the fibers by being intimately mixed with the polymer used to form the fibers. A second flame retardant is then surface applied to the fabric or to the yarns used to form the fabric. The fabric has a total flame retardant compound concentration of at least 5000 ppm. In one embodiment, the fabric can be combined with other fabric layers to produce a composite fabric product.

44 Claims, 2 Drawing Sheets

(56) References Cited

U.S. PATENT DOCUMENTS 4,129,551 A 12/1978 Rueter et al.
4,198,494 A 4/1980 Burckel
4,385,131 A 5/1983 Fracalossi et al.
4,525,168 A 6/1985 Kelly
4,594,286 A 6/1986 McKinney et al.
4,666,960 A 5/1987 Spain
4,705,527 A 11/1987 Hussamy
4,710,200 A 12/1987 Cates et al.
4,722,735 A 2/1988 Brodmann
4,726,987 A * 2/1988 Trask et al. ..... 442/373
4,749,378 A 6/1988 Cates et al.
4,752,300 A 6/1988 Johnson
4,759,770 A 7/1988 Cates et al.
4,842,609 A 6/1989 Johnson
4,865,906 A 9/1989 Smith, Jr.
4,868,041 A 9/1989 Yamagishi et al.
4,869,947 A 9/1989 Kirayoglu
4,898,596 A 2/1990 Riggins et al.
4,900,613 A 2/1990 Green
4,911,730 A 3/1990 Cates et al.
4,920,000 A 4/1990 Green
4,958,485 A 9/1990 Montgomery et al.
4,981,488 A 1/1991 Cates et al.
4,990,368 A 2/1991 Johnson et al.
4,994,317 A 2/1991 Dugan et al.
5,025,537 A 6/1991 Green
5,077,126 A 12/1991 Green
5,136,723 A 8/1992 Aldridge et al.
5,150,476 A 9/1992 Statham et al.
5,191,777 A 3/1993 Schnegg
5,215,545 A 6/1993 Cates et al.
5,236,769 A * 8/1993 Paire ..... 428/196
5,275,627 A 1/1994 Cates et al.
5,306,312 A 4/1994 Riggins et al.
5,356,700 A 10/1994 Tanaka et al.
5,388,270 A 2/1995 Hewitt
5,402,362 A 3/1995 Prosser
5,447,540 A 9/1995 Kobayashi et al.
5,527,597 A 6/1996 Stanhope et al.
5,560,990 A 10/1996 Ilg et al.
5,567,517 A * 10/1996 Nakajima et al. ..... 428/364
5,582,912 A 12/1996 McCullough, Jr. et al.
5,607,483 A 3/1997 Burkinshaw et al.
5,694,981 A 12/1997 Stanhope et al.
5,727,401 A 3/1998 Statham
5,747,392 A 5/1998 Xiao et al.
5,773,502 A * 6/1998 Takekoshi et al. ..... 524/411
5,824,614 A * 10/1998 Gadoury ..... 442/415
5,830,574 A 11/1998 Gadoury
5,849,648 A 12/1998 Kent et al.
5,873,914 A 2/1999 Burkinshaw et al.
5,880,042 A 3/1999 Schuster et al.
5,885,307 A 3/1999 Gadoury
5,928,971 A 7/1999 Ellis et al.
6,018,819 A * 2/2000 King et al. ..... 2/69
6,065,153 A 5/2000 Underwood et al.
6,132,476 A 10/2000 Lunsford et al.
6,136,892 A 10/2000 Yamauchi et al.
6,194,329 B1 2/2001 Nelson et al.
6,215,545 B1 4/2001 Matsuyama
6,296,023 B1 10/2001 Gehrhardt et al.
6,451,070 B1 9/2002 Kent et al.
6,472,456 B1 10/2002 Horsey et al.
6,531,419 B1 3/2003 Wyner et al.
6,547,835 B1 4/2003 Lunsford et al.
6,562,741 B1 5/2003 Lilani
6,576,025 B2 6/2003 Lapierre
6,599,963 B2 7/2003 Horsey et al.
6,607,562 B2 8/2003 Ghorashi et al.
6,624,096 B2 9/2003 Thomas et al.
6,705,353 B2 * 3/2004 Hotta et al. ..... 139/421
6,759,127 B1 * 7/2004 Smith et al. ..... 428/395
6,818,024 B2 11/2004 Lunsford et al.
6,840,967 B1 1/2005 Riggins et al.
6,867,143 B1 3/2005 Furukawa et al.
6,867,154 B1 3/2005 Lunsford et al.
6,886,184 B2 5/2005 Underwood et al.
6,913,720 B2 7/2005 Raponi et al.
7,008,694 B1 3/2006 Frankel
7,013,496 B2 3/2006 Dunn
7,065,950 B2 * 6/2006 Zhu et al. ..... 57/255
7,156,883 B2 1/2007 Lovasic et al.
7,393,800 B2 7/2008 Corner
7,410,695 B2 * 8/2008 Rabe et al. ..... 428/359
7,410,920 B2 * 8/2008 Davis ..... 442/334
7,504,449 B2 * 3/2009 Mazor et al. ..... 524/369
7,666,802 B2 * 2/2010 Capwell ..... 442/136
7,741,233 B2 * 6/2010 Sasser et al. ..... 442/136
7,754,140 B2 7/2010 Rajner et al.
7,820,572 B2 * 10/2010 Zhu et al. ..... 442/301
RE42,209 E 3/2011 Lunsford et al.
2001/0001753 A1 * 5/2001 Nelson et al. ..... 442/131
2001/0004571 A1 * 6/2001 Nelson et al. ..... 442/71
2001/0004780 A1 6/2001 Mach et al.
2002/0069453 A1 * 6/2002 Kelleher et al. ..... 2/458
2003/0065105 A1 * 4/2003 Kato et al. ..... 525/418
2003/0114070 A1 * 6/2003 Raponi et al. ..... 442/402
2003/0148689 A1 8/2003 Lapierre
2003/0167580 A1 9/2003 Lunsford et al.
2004/0152378 A1 * 8/2004 Stanhope ..... A41D 31/0022 442/5
2004/0253441 A1 * 12/2004 Bansal et al. ..... 428/373
2005/0024962 A1 2/2005 Zhu et al.
2005/0060820 A1 3/2005 Lunsford et al.
2005/0130533 A1 6/2005 Lapierre
2005/0245164 A1 * 11/2005 Aneja et al. ..... 442/414
2005/0277353 A1 12/2005 Lovasic et al.
2006/0035555 A1 * 2/2006 Narayanan et al. ..... 442/387
2006/0093870 A1 * 5/2006 Davis ..... 428/920
2006/0266986 A1 * 11/2006 Day et al. ..... 252/608
2008/0038973 A1 * 2/2008 Sasser et al. ..... 442/181
2008/0134407 A1 6/2008 Winterhalter et al.
2008/0153372 A1 6/2008 Truesdale et al.
2009/0053494 A1 * 2/2009 Davis ..... 428/219
2009/0148654 A1 * 6/2009 Brown et al. ..... 428/96
2009/0181588 A1 * 7/2009 Capwell ..... D06M 11/44 442/64
2009/0320176 A1 * 12/2009 Curtis ..... 2/81
2010/0151759 A1 * 6/2010 Capwell ..... 442/71
2011/0023206 A1 2/2011 Dunn et al.
2011/0076494 A1 * 3/2011 Gunzel et al. ..... 428/355 R
2011/0135900 A1 * 6/2011 Davis ..... 428/219
2012/0052217 A1 * 3/2012 Monfalcone et al. ..... 428/7
2012/0141723 A1 * 6/2012 Chuah et al. ..... 428/85

FOREIGN PATENT DOCUMENTS

EP 0 228 026 A2 7/1987
EP 0 237 451 A1 9/1987
EP 0 314 244 A2 5/1989
EP 0 330 163 A2 8/1989
EP 0 385 024 A1 9/1990
EP 0 432 100 A1 6/1991
EP 0 487 568 A1 6/1992
EP 0 557 734 A1 9/1993
EP 0 875 620 A1 11/1998
GB 2 332 001 6/1999
JP 63196741 8/1988
JP 2182936 7/1990
JP 2221432 9/1990
JP 4263646 9/1992
JP 8226031 9/1996
JP 9296335 11/1997
JP 10060787 3/1998
WO WO 90/06229 A1 6/1990
WO WO 91/02837 A1 3/1991
WO WO 93/19241 A1 9/1993
WO WO 94/25665 A1 11/1994
WO WO 98/12373 A1 3/1998
WO WO 98/54399 A1 12/1998
WO WO 99/35315 A1 7/1999
WO WO 0166193 A1 * 9/2001

(56) References Cited

FOREIGN PATENT DOCUMENTS

| | | | |
|---|---|---|---|
| WO | WO 2007096883 | A2 * | 8/2007 |
| WO | WO 2009/012266 | A2 | 1/2009 |
| WO | WO 2009/012266 | A9 | 1/2009 |

OTHER PUBLICATIONS

"Advances in Military Protective Clothing Materials", presentation by the U.S. Dept. Of the Army, Thomas H. Tassinari and Laurance Coffin, not dated, 16 pages.
"Aramid fibres", J.E. McIntyre, Rev. Prog. Coloration, vol. 25, 1995, pp. 44-56.
"Clothing for Work and Protection", R. Jeffries, Lenzinger Berichte, Aug. 1989, pp. 25-33.
"Demand Heats Up", Doug Jackson, Safety & Protective Fabrics, Sep. 1992, pp. 32-35.
"Flame Retardant Viscose Rayon Containing a Pyrophosphate", Rainer Wolf, Ind. Eng. Chem. Prod. Res. Dev., 1981, vol. 20, pp. 413-420.
"In the heat of combat, Flame-Resistant, Protective Apparel of NOMEX gives you a fighting chance", DuPont NOMEX Brochure, 1996, 8 pages.
"Measuring the Effects of Intense Heat and Dynamic Mechanical Forces on Thermal Protective Fabrics", Geshury et al., High-Tech Fibrous Materials, ACS Symposium Series, American Chemical Society, 1991, pp. 278-292.
DuPont NOMEX IIIA brochure, 1994, 5 pages.
DuPont NOMEX Laundering Guide, 1997, 22 pages.
Technical Guide for NOMEX Brand Fiber, 2001, 40 pages.
"Novel Approach to Soldier Flame Protection" Presentation by U.S. Army Natick Soldier Center, Winterhalter and Martin, 2011, 22 pages.
Novel Polymer Solutions, http://www.novelpolymers.co.uk, at least as early as Apr. 12, 2011, 2 pages.
"Novel Approach to Soldier Flame Protection", Winterhalter et al., Journal of ASTM International, Feb. 2005, Fol. 2, No. 2, pp. 227-234.
DuPont KARVIN brochure, not dated, 4 pages.
"Printing Technology for Aramid Fabrics", Hodge et al., High-Tech Fibrous Materials, ACS Symposium Series, American Chemical Society, 1991, pp. 270-276.
"Properties and Processing Guidelines for Lenzing FR", not dated, 21 pages.
"Protective Clothing of DuPont NOMEX and Heat Stress", brochure, 2000, 2 pages.
"The Dyeing, Finishing and Performance of Fabrics for Military Uniforms", John V. Morris, Rev. Prog. Coloration, vol. 11, 1981, pp. 9-18.
TL 8415-0235, 2008, 21 pages.
"Dyeing and Finishing of KARVIN", Sep. 1982, 7 pages.
"The Processing of KARVIN in Modified Cotton Spinning and in Weaving Mills", Sep. 1982, 6 pages.
"Yarns, Fabrics and Garments made with KARVIN", Sep. 1982, 13 pages.

* cited by examiner

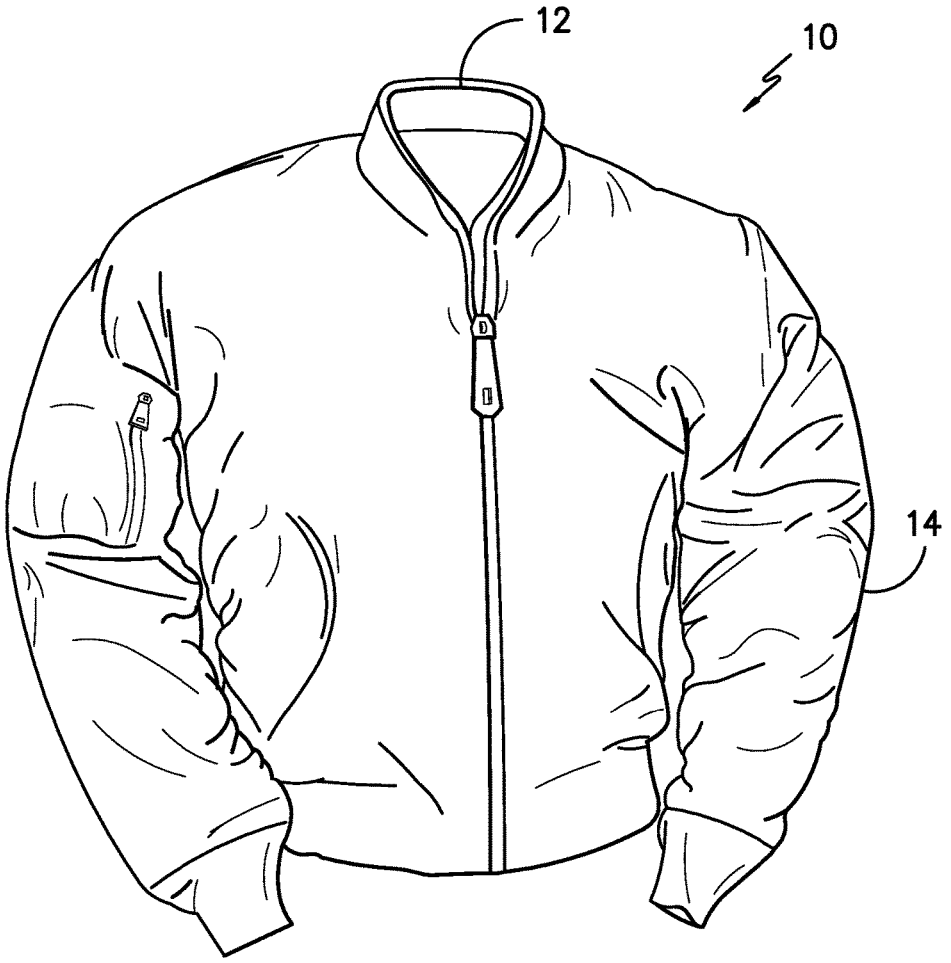
*FIG. –1–*

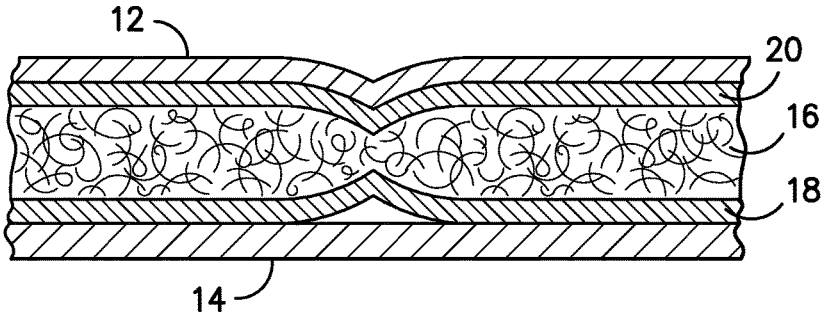
FIG. –2–
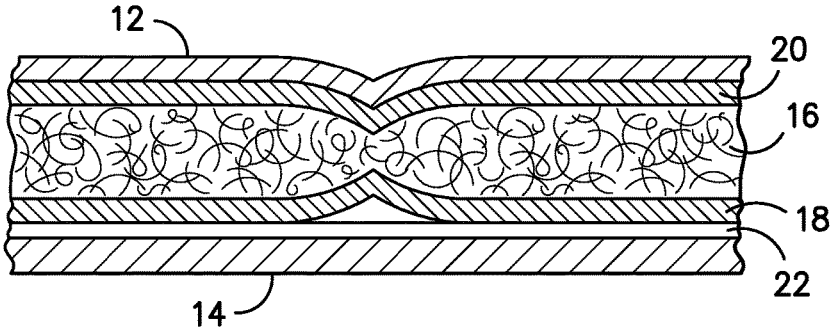
FIG. –3–

FLAME RESISTANT FABRIC AND GARMENT

RELATED APPLICATIONS

The present application is based upon and claims priority to U.S. Provisional Patent Application Ser. No. 61/235,911, filed on Aug. 21, 2009.

BACKGROUND

Military personnel are issued and wear many different types of clothing items depending upon the actions they are performing, the climate they are working in, and based on various other factors. Such clothing items can include, for instance, pants, shirts, coats, hats, jackets, and the like. The clothing items are intended not only to keep the wearer warm and sheltered from the elements but to also provide protection, especially in combat areas.

Recently, greater attention has been focused on developing garments for military personnel that have flame resistant properties. The flame resistant properties are intended to protect the wearer when exposed to flash fires. The push to increase the flame resistant properties of clothing worn by military personnel is primarily in response to the various different types of incendiary devices that military personnel may be exposed to in the field.

In the past, in order to produce fabrics having flame resistant properties, the fabrics were typically made from inherently flame resistant fibers. Such fibers, for instance, may comprise aramid fibers such as meta-aramid fibers or para-aramid fibers. Such fibers, for instance, are typically sold under the trade names NOMEX® or KEVLAR®. The use of inherently flame resistant fibers to produce garments, such as those worn by military personnel, are disclosed in U.S. Pat. Nos. 4,759,770, 5,215,545, 6,818,024, and 7,156, 883, which are all incorporated herein by reference.

Although the use of inherently flame resistant fibers can produce garments having excellent flame resistant properties, the above fibers do have some disadvantages and drawbacks. For example, fabrics made from the fibers tend to be relatively heavy, may not be water resistant, and may not be wind resistant. Inherently flame resistant fibers are also somewhat expensive and are difficult to dye and/or print, thus making it difficult to apply a camouflage pattern to the fabrics.

Military personnel do wear various articles of clothing made from polyester fibers and/or nylon fibers. Such articles of clothing can be lightweight and highly water and wind resistant. The articles of clothing can also be made highly breathable. Such garments, however, typically have poor fire resistant properties. In fact, some of the fabrics used to produce the above garments have a tendency to melt, drip, and/or produce after flames once exposed to an open flame that can in fact increase fire related injuries.

In view of the above, a need currently exists for lightweight and wind resistant fabrics that have excellent flame resistant properties. A need also exists for a flame resistant and lightweight fabric that has highly water resistant properties, even after being laundered. In addition, a need also exists for such fabrics that can also provide near infrared (nIR) spectral suppression or accept a camouflage pattern.

SUMMARY

In general, the present disclosure is directed to a fabric that has excellent flame resistant properties without having been constructed from substantial amounts of inherently flame resistant fibers, such as aramid fibers. Fabrics made according to the present disclosure, for instance, can be lightweight and be highly breathable. The fabrics can also have excellent vapor transmission properties while also being water resistant. In one embodiment, the fabrics can also include a spectral reflectance agent that provides camouflage protection (nIR).

As described above, fabrics made according to the present disclosure can be produced without containing substantial amounts of aramid fibers. Instead, the fabrics can be produced from other synthetic fibers, such as polyester fibers, non-aromatic polyamide fibers or mixtures thereof. As will be described in greater detail below, at least one flame retardant compound is incorporated into the fibers and/or the fabric in order to produce a fabric product having excellent flame resistant properties. In fact, fabrics can be made in accordance with the present disclosure that, when tested according to ASTM D6413, exhibit a char length of less than about 6 inches in at least on direction, have an after flame time of less than about 2 seconds and do not produce any drips during the test.

For example, in one embodiment, the present disclosure is directed to a flame resistant article of clothing comprising a garment having a shape and size configured to cover a portion of a wearer's body. The garment is made from a woven or knitted fabric constructed from yarns. The yarns are comprised of synthetic fibers such as polyester fibers, non-aramid polyamide fibers, or mixtures thereof. As described above, in one embodiment, the fabric can be produced without containing any aramid fibers. Alternatively, relatively minor amounts (less than 5% by weight) of aramid fibers may be present in the yarn such as spun NOMEX yarns.

In accordance with the present disclosure, the fabric contains at least one flame retardant compound such that the total concentration of flame retardant compounds in the fabric is at least 5000 ppm. For instance, in one embodiment, the fabric can contain a first flame retardant compound and a second flame retardant compound. The first flame retardant compound can be incorporated into the fiber while the second flame retardant compound may have been surfaced applied to the yarn either before or after construction of the fabric.

As described above, the first flame retardant compound is incorporated into the fibers. As used herein, the phrase "incorporated into the fibers" means that the flame retardant compound is mixed with the synthetic polymer during formation of the fibers. For instance, in one embodiment, the first flame retardant compound may be extruded with the polymer used to form the fiber.

The first flame retardant compound and the second flame retardant compound may be the same or different. In one embodiment, the first flame retardant compound and/or the second flame retardant compound may comprise a phosphorous compound or a bromine compound. As described above, the concentration of the flame retardant compound contained in the fabric is at least about 5000 ppm, such as from about 6000 ppm to about 50,000 ppm, such as from about 10,000 ppm to about 40,000 ppm.

The yarns used to produce the fabric may comprise textured yarns, such as air jet textured yarns or false twist textured yarns, or various types of spun yarns (ring, OE, etc). The yarns can have a denier of from about 20 to about 1000. In one embodiment, the fabric can have a relatively light weight. For instance, the fabric can have a basis weight of from about 1 oz/yd$^2$ to about 10 oz/yd$^2$. In addition, the fabric can be highly constructed and relatively wind resistant. For instance, the fabric can have an air porosity of less than about 5 cfm/ft$^2$, such as less than about 2 cfm/ft$^2$, such as less than about 1 cfm/ft$^2$.

Of particular advantage, fabrics, made according to the present disclosure have been found to have excellent flame resistant properties even when combined with a durable water resistant treatment (DWR treatment) and/or with a spectral reflectance agent. The addition of these agents generally degrades the flame resistant (FR) properties of a fabric. The DWR treatment, for instance, may comprise a fluoropolymer that is surface applied to the fabric. The DWR treatment improves water resistance and, in one embodiment, can provide the fabric with water resistant properties, even after being laundered at least 25 laundry cycles.

A spectral reflectance agent, on the other hand, generally comprises an additive applied by printing, in a pad application that or incorporated into the fibers that affects the spectral reflectance properties of the fabric over a range of wave lengths. A spectral reflectance agent, for instance, can assist in rendering the fabric less noticeable when viewed with night vision goggles. In one embodiment, for instance, the spectral reflectance agent comprises a carbon binder which, normally can significantly degrade the fire resistant properties of the yarns. The present Inventor, however, unexpectantly discovered that fabrics made according to the present disclosure can still obtain the flame resistant properties even when carbon is associated with the fibers.

The final amount of the spectral reflectance agent in the fabric range can vary depending on various factors. In one embodiment, the synthetic fibers used to produce the fabric can contain carbon black in an amount from about 0.05% to about 4% by weight, such as from 0.05% to 2% by weight. The balance between the carbon loading for nIR suppression and the FR compounds for flame resistant properties should be balanced and optimized.

The amount of the spectral reflectance agent incorporated into the fabric can depend, for instance, on the desired level of nIR suppression based on a range of colors, such as from a desert tan color to a forest green color. The amount of spectral reflectance agent incorporated into the fabric can also depend upon the fabric construction. In one particular embodiment, for instance, carbon can be loaded into the fabric in an amount from about 0.1% to about 0.6% by weight. In one particular embodiment, for instance, carbon can be loaded into the fabric in an amount of about 0.4% by weight. The carbon black can be present in the fibers such that that fabric has a nIR reflectance at a wave length of from about 600 nm to about 1200 nm of from about 20% to about 80% suppression depending on this loading.

In one embodiment, the garment of the present disclosure includes an interior surface that faces a wearer and an exterior surface. The fabric made according to the present disclosure can serve as the interior surface, the exterior surface, or both.

For instance, in one embodiment, the garment may comprise, for instance, a jacket or leg covering made from a composite fabric product. The composite fabric product may include an outer shell, a liner, and optionally one or more middle layers. The fabric made according to the present disclosure can comprise the outer shell or the liner. Various different types of fabric layers may be contained in between the outer shell and the liner. For instance, in one embodiment, the middle layer may comprise a thermal barrier layer made from a hydroentangled web. In another embodiment, the composite fabric product may contain a filing layer comprised of a nonwoven loft material.

Other features and aspects of the present disclosure are discussed in greater detail below.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which:

FIG. 1 is a perspective view of one embodiment of a flame resistant jacket made in accordance with the present disclosure;

FIG. 2 is a cross-sectional view of the jacket illustrated in FIG. 1; and FIG. 3 is a cross-sectional view of another embodiment of a composite fabric product made in accordance with the present disclosure.

Repeat use of reference characters in the present specification and drawings is intended to represent the same or analogous features or elements of the present invention.

DETAILED DESCRIPTION

It is to be understood by one of ordinary skill in the art that the present discussion is a description of exemplary embodiments only, and is not intended as limiting the broader aspects of the present invention.

In general, the present disclosure is directed to the production of flame resistant fabrics that are made primarily from fibers that are not naturally or inherently flame resistant. More particularly, the present disclosure is directed to polyester and/or nylon fabrics that have excellent flame resistant properties for use in constructing various clothing items, including garments that are particularly well suited for use by military personnel.

Fabric made according to the present disclosure can provide various advantages and benefits over flame resistant fabrics made in the past that contain substantial amounts of naturally fire resistant fibers, such as para-aramid fibers and/or meta-aramid fibers. For instance, the fabrics of the present disclosure can be constructed to not only have a lighter weight, but also can have excellent wind and water resistant properties while remaining highly breathable, especially in comparison to fabrics made from aramid fibers. In addition, fabrics made according to the present disclosure can also have better drape properties and surface texture. In addition, fabrics of the present disclosure can be produced economically, especially in comparison to fabrics containing aramid fibers.

In the past, many different fabrics have been produced from nylon and/or polyester fibers. Such fabrics, however, typically did not possess any flame resistant properties. To the contrary, nylon and polyester are known to not only burn when exposed to an open flame, but also have a tendency to melt and stick to human skin. Thus, these types of fibers have typically been avoided for use in applications where flame resistant properties were needed.

Some polyester and nylon fabrics have been produced that have some flame resistant characteristics. For instance, fabrics used to produce mattresses and the like have been treated with flame retardant compositions that have provided some protection against burning. In the past, however, typically flame retardants incorporated into the fabrics have been at concentrations well below 3000 ppm. The present Inventor, on the other hand, has discovered a method for incorporating one or more flame retardant compounds into polyester and/or nylon fabrics at concentrations well above 3000 ppm. For instance, fabrics made in accordance with the present disclosure may have a total flame retardant compound concentration of greater than about 5000 ppm, such as from about 6000 ppm to about 50,000 ppm. In various embodiments, for example, the total flame retardant compound concentration in the fabric can be from about 10,000 ppm to about 40,000 ppm, such as from about 15,000 ppm to about 30,000 ppm.

Fabrics made in accordance with the present disclosure exhibit sufficient flame resistant properties so as to protect a wearer against flash fires and electric arcs. For instance, one test for measuring the flame resistant properties of a fabric is known as the vertical flame test. The vertical flame test has been standardized as the ASTM D-6413 test. The test measures the vertical flame resistance of textiles. In particular, a specimen of a fabric is suspended vertically in a holder. A controlled flame is then impinged on the bottom cut edge of the fabric for 12 seconds. Upon removing the flame at the end of the 12 second period, different characteristics of the fabric are measured. The first characteristic is referred to as "after flame or glow" and represents the number of seconds during which there is a visible flame remaining on the fabric after the controlled flame has been removed. Further, the char length of the fabric can be measured which is the length of fabric destroyed by the flame that will readily tear by application of a standard weight. The third characteristic is any evidence of melting and dripping. In conducting the test, five specimens are tested in both the warp and weft directions and the results are averaged.

Fabrics made according to the present disclosure, for instance, when tested according to the vertical flame test (ASTM D6413) can be designed so as to exhibit a char length of less than about 6 inches in at least one direction or in both directions, have an after flame of less than about 2 seconds, and exhibit substantially no dripping. In comparison, similar polyester or nylon fabrics, when subjected to the vertical flame test, typically exhibit a torch-like burn pattern and exhibit char lengths greater than the specimen length (12 inches) and after flames of 10 seconds or greater. The fabrics also have a tendency to melt and drip during the test. Fabrics made in accordance with the present disclosure, however, can be subjected to the vertical flame test without producing any drips.

Of particular advantage, fabrics made according to the present disclosure can also display the above flame resistant properties even after being laundered multiple cycles. A standard laundry cycle, for instance, is described in U.S. Pat. No. 6,886,184, which is incorporated herein by reference. The laundry method is test AATCC 135,(1),IV,A,(1)-normal wash cycle, 120° F., tumble dry cotton sturdy cycle. During a laundry cycle, the fabric is washed in an automatic washer, followed by drying in an automatic dryer. Fabrics, made according to the present disclosure display relatively little decrease in their flame resistant properties even when subjected to 25 laundry cycles. For instance, fabrics made according to the present disclosure can exhibit a char length of still less than 6 inches when subjected to 50 laundry cycles.

As will be described in greater detail below, fabrics made in accordance with the present disclosure can be constructed so as to not only display excellent flame resistant properties, but can also be designed to be water resistant and/or can have desirable spectral reflectance agents for use in camouflage application.

Fabrics made in accordance with the present disclosure can be used to produce numerous different types of clothing articles and other related products. For instance, the fabric can be used to produce shirts, pants, gloves, hats, leg wear including socks, uniforms, and the like. The fabrics may be used in a single layer application or may be combined with other various different types of textile materials in order to form a fabric composite product. The fabric composite product can then be used to produce various different types of articles, such as coats, jackets, overalls, gloves, and the like.

Although the fabric is particularly well suited for producing garments that may be used in military applications, it should be understood that the fabric may be equally applicable to various other uses in other fields. For instance, garments made in accordance with the present disclosure may also be used by athletes, firefighters, emergency personnel, hunters, outdoor enthusiasts, and the like.

In general, the fabric is formed from a fiber containing primarily synthetic fibers. The synthetic fibers, for instance, may comprise nylon fibers, polyester fibers, or mixtures thereof. In addition to the above fibers, various other fibers may be present in the fabric. For instance, the fabric may contain, in some embodiments, natural fibers such as cotton fibers, rayon fibers, other cellulose fibers, wool fibers, and the like. Although the fabric is primarily constructed from non-aramid fibers, it should be understood that small amounts of aramid fibers may be incorporated into the fabric if desired. For instance, para-aramid fibers may be incorporated into the fabric in an amount of up to about 10% by weight in order to provide some type of benefit. For instance, in one embodiment, para-aramid fibers, such as Kevlar® fibers, may be incorporated into the fabric for shrink control. In certain embodiments, however, the fabric can be produced without containing any naturally flame resistant fibers.

The fibers used to produce the fabric are constructed into yarns that are then woven or knitted together. Each yarn can comprise a blend of fibers or may contain a single fiber type. For instance, in one embodiment, the fabric may contain yarns comprised of blended fibers of, for example, polyamide fibers and polyester fibers.

When the yarns are constructed from a single fiber type, yarns made from one type of fiber may be combined with yarns made from a different type of fiber. For example, in an alternative embodiment, the fabrics may contain yarns made exclusively from polyester fibers and yarns made exclusively from polyamide fibers. For example, in one particular embodiment, the fabrics may include warp yarns made from a first fiber type and may contain weft yarns produced from a second fiber type.

The yarns used to construct the fabric may comprise spun yarns, filament yarns, or mixtures thereof. Filament yarns may be used, for instance in high constructions, to produce a fabric having good wind resistant properties and be highly water resistant. Filament yarns may also produce a fabric that is more breathable especially when compared to products produced with FR coatings. When using filament yarns, the yarns may be textured. For example, the yarns may be air jet textured or false twist textured.

Fabrics made in accordance with the present disclosure can be either woven or knitted. If woven, the fabric can have any suitable construction depending upon the particular application. For instance, the woven fabric can have a plain weave, a twill weave, a rip stop weave, or any other suitable weave.

The size of the yarns used to form the fabric can vary dramatically depending upon the particular application and the desired result. Yarn sizes, for instance, can vary from about 20 denier to about 1000 denier. The weave density of the fabric can generally vary with the yarn sizes. For instance, a fabric produced from 20 denier yarns may have approximately 300 to about 350 ends and from about 200 to about 250 picks. A product produced from 50 denier yarns, on the other hand, may have from about 150 to about 200 ends and from about 100 to about 130 picks. A fabric produced from 70 denier yarns, on the other hand, may have from about 140 to about 160 ends and from about 80 to about 90 picks. A fabric produced from 150 denier yarns, on the other hand, may have from about 100 to about 120 ends and from about 60 to about 80 picks. A fabric made from 200 denier yarns may have from about 90 to about 110 ends and from about 60 to about 70 picks. A fabric produced from 500 denier yarns, on the other hand, can have from about 55 to about 65 ends and from about 45 to about 55 picks. In still another embodiment, a fabric produced from 1000 denier yarns may have from about 30 to about 40 ends and from about 30 to about 35 picks.

In one embodiment, fabrics of the present disclosure can be constructed so as to be wind resistant. In this embodiment, relatively small denier yarns can be used to construct the fabric. In addition to using small denier yarns, the fabric can also be produced having a relatively dense weave. Ultimately, a fabric can be constructed having an air permeability of less than about 5 cfm/ft$^2$, such as from about 0.5 cfm/ft$^2$ to about 2 cfm/ft$^2$. In one particular embodiment, for instance, the fabric can have an air permeability from about 0.8 cfm/ft$^2$ to about 1.8 cfm/ft$^2$, such as from about 1.0 cfm/ft$^2$ to about 1.5 cfm/ft$^2$.

When constructing fabrics from coarser yarns, on the other hand, the fabric can have an air permeability of greater than about 5 cfm/ft$^2$, such as from about 10 cfm/ft$^2$ to about 50 cfm/ft$^2$.

When producing wind resistant fabrics, the denier of the yarns can generally be less than about 200. For example, the denier of the yarns can be from about 20 to about 150, such as from about 50 to about 100. In one particular embodiment, for instant, a wind resistant fabric can be constructed from filament yarns of polyester and/or nylon filaments of a denier of about 70.

In applications where a low air permeability or wind resistance is not needed or desired, it should be understood that yarns may be used having deniers greater than 200. For instance, in other applications, the denier of the yarns may be from about 200 to about 1000. In addition, instead of filament yarns, spun yarns may also be used. Although the use of spun yarns may decrease wind resistance, such yarns may make the fabric more breathable.

In certain embodiments, it may be desirable to also incorporate a significant amount of stretch into the fabric. Stretch can be increased in the fabric by incorporating certain types of yarns, such as relatively high shrink yarns and/or yarns made from an elastic material, into the weave. Yarns that increase the stretch of the fabric, however, have been found in the past to adversely affect the fire resistant properties of the fabric. The present inventors discovered, however, that stretch yarns can be incorporated into the fabric without significantly compromising the fire resistant properties, due to the manner in which the fire retardant compounds are incorporated into the fabric.

In one embodiment, for instance, in order to improve the stretch characteristics of the fabric, mechanically textured yarns may be included in the fill direction and/or in the warp direction of the fabric. Replacing fill yarns with stretch yarns can increase stretch in the cross direction, while replacing warp yarns with stretch yarns can increase stretch in the machine direction or warp direction of the fabric.

Mechanically textured yarns are yarns that have been subjected to a mechanical draw twisting or texturing process, including crimping. A mechanically textured yarn made from, for instance, polyester or nylon, may have increased shrink properties in relation to the other yarns used to form the fabric. When the yarns are subjected to steam or high temperatures during processing, they shrink incorporating long-lasting stretch and recovery properties into the fabric. When using mechanically textured yarns, for instance, the fabric can have from about 5% to about 15% stretch properties in at least one direction, such as in both directions. For instance, the fabric can have from about 7% to about 12% stretch properties in one or both directions.

The amount of shrink yarns incorporated into the fabric may depend upon various factors including the amount of stretch desired. In one embodiment, for instance, from about 10% to about 60% of the yarns in one or both directions may comprise stretch yarns as described above. For instance, in one embodiment, from about 20% to about 50% of the yarns in the fill direction or the warp direction may comprise stretch yarns. In general, the stretch yarns can be equally spaced apart in the fill direction or warp direction. For instance, when stretch yarns comprise 50% of the yarns in the fill direction, every other yarn may comprise the stretch yarn. In other embodiments, however, every third yarn or every fourth yarn or every fifth yarn may comprise the stretch yarn.

In addition to using mechanically textured yarns, in an alternative embodiment, the stretch of the fabric may be increased by incorporating yarns made from an elastomeric material into the fabric. In one embodiment, for instance, lycra yarns may be used. Lycra yarns are yarns made from elastane which, in one embodiment, is a polyurethane-polyurea copolymer. Incorporating elastomeric fibers into the fabric may produce stretch in the fabric in at feast one direction of from about 5% to about 30%, such as from about 10% to about 15%. When an elastomeric yarn is incorporated into the fabric, the elastomeric yarn may generally comprise less than about 10% by weight of the fabric, such as from about 4% to about 6% by weight. In one embodiment, elastomeric yarns can be incorporated into the fill direction of the fabric and spaced apart in discrete locations such that the elastomeric yarn becomes buried among the other yarns while still providing significant stretch properties.

Fabrics made according to the present disclosure can have any suitable basis weight. In one embodiment, however, a relatively light weight fabric can be produced which may provide various advantages and benefits when constructing clothing articles. In general, for instance, the fabrics can have a basis weight of generally from about 1 oz/yd$^2$ to about 12 oz/yd$^2$. When producing lightweight fabrics, however, fabrics generally can have a basis weight of less than about 8 oz/yd$^2$, such as from about 2 oz/yd$^2$ to about 6 oz/yd$^2$. In one particular embodiment, for instance, a fabric suitable for producing jackets and other clothing items may have a basis weight of about 4 oz/yd$^2$.

Fabrics made according to the present disclosure can generally be highly breathable. For instance, fabrics can be constructed having a moisture vapor transmission rate of greater than about 600 g/m$^2$/24 hrs, such as greater than about 800 g/m$^2$/24 hrs or greater than about 1000 g/m$^2$/24 hrs. For instance, in one embodiment, the fabrics can have a moisture vapor transmission rate of from about 1000 g/m$^2$/24 hrs to about 3000 g/m$^2$/24 hrs, according to test method ASTM E 96 Procedure B.

As described above, fabrics made according to the present disclosure have excellent flame resistant properties. The flame resistant properties are achieved by incorporating into the fabrics one or more flame retardant compounds. The flame retardant compounds can be intimately mixed with the polymer used to form the fibers and/or surface applied to the yarns. When surface applied to the yarns, the flame retardant compound can be applied to the yarns before or after the fabric is produced. In accordance with the present disclosure, the fabric contains a total fire retardant compound concentration of greater than about 5000 ppm. For instance, the total flame retardant compound concentration contained in the fabric can be from about 6000 ppm to about 50,000 ppm, such as from about 10,000 ppm to about 40,000 ppm.

In one embodiment, for instance, a first flame retardant compound can be incorporated into the fibers at a concentration of from about 4000 ppm to about 12,000 ppm, such as from about 6000 ppm to about 8000 ppm. A second flame retardant compound can then be surface applied to the yarns. The second flame retardant compound can be present in the fabric at a concentration of from about 7000 ppm to about 25,000 ppm, such as from about 10,000 ppm to about 20,000 ppm.

The flame retardant compounds incorporated into the fabric can vary depending upon the particular application and how the compound is applied. Flame retardant compounds that are particularly well suited for use in the present disclosure include phosphorous-based compounds and/or halogen containing compounds, such as bromine compounds. Phosphorous compounds that may be used include organophosphorous compounds, phosphonate esters including cyclic phosphonate esters, phosphate esters, phosphazenes, and mixtures thereof. Bromine compounds that may be used include bromine-containing aromatics, such a brominated diphenyls.

As described above, one or more flame retardant compounds can be incorporated into the fibers used to form the fabric or can be surface applied to the yarn. The following are flame retardant compounds that may be incorporated directly into the polymer fibers. In this embodiment, one or more flame retardant compounds, for instance, may be compounded with the polymer resin that is used to form the fibers. The polymer resin can then be extruded together with the flame retardant compounds in forming the fibers.

In one embodiment, pentabromobenzylbromide (PBBBr) is used as a flame retardant in a polymer. Additionally, PBBBr may be combined with at least one or more additional flame retardants selected from the group consisting a brominated flame retardant, a chlorinated flame retardant, a modacrylic, a phlyhaloalkene, an organophosphorus compound, a melamine, a polyaramide, a carbonized acrylic, or glass. The flame retardant is preferably selected from brominated and chlorinated flame retardants, preferably decabromodiphenyloxide (DECA). A smoldering suppressant of either urea, melamine, and phosphate salts may be included. Preferably the smoldering suppressant is an ammonium phosphate, preferably ammonium polyphosphate. Antimony oxide may be added as a synergist.

In another embodiment red phosphorous is used as a flame retardant without using a hydrated metal compound.

In another embodiment a halogen containing flame retardant is used such as hexabromobenzene, hexachlorobenzene, hexabromobiphenyl, hexachlorobiphenyl, decabromobiphenyl, decachlorobiphenyl, decabromobiphenyl ether, decachlorobiphenyl ether, 2,2-(3,3',5,5'-tetrabromo-4,4'-dihydroxy-diphenyl) propane, 2,2-(3,3',5,5'-tetrachloro-4,4'-dihydroxy-diphenyl) propane, an adduct of cyclohexane or hexachlorocyclopentadiene (chloran).

In another embodiment the flame retardant composition comprises 0.1-2% by weight of phosphorus provided by an organic, oxygen-containing phosphorus compound and 1-5% by weight of bromine provided by a ring-brominated aromatic compound. Preferably the phosphorus compound is triphenylphosphine oxide and the bromine compound is an octyl-, nonyl-, undecyl-, dodecyl-, tetradecyl-, or octadecyl-tri-tetra- or pentabromobenzene, a mixture of (tribromophenyl)dodecane isomers, a mixture of (tribromophenyl) tetradecane isomers, a mixture of (tetrabromophenyl) undecane isomers, mixture of (tribromophenyl)dodecane, (tribromophenyl)tetradecane and (tetrabromophenyl)undecane isomers, or a mixture of (tribromophenyl)octane isomers.

In another embodiment the flame retardant compound comprises a cyclic phosphate ester such as Antiblaze 19T available from Mobil Chemical Company, a methyl ester of phosphonic acid, or Caliban P-44 which contains decabromodiphenyloxide and antimony oxide available from White Chemical Company.

In another embodiment, the flame retardant compound comprises cyclic phosphazenes and linear phosphazene derivatives. Examples of the cyclic phosphazene derivatives represented by the general formula (I) for the flame-resistant fiber of the present invention include 1,1,3,3,5,5-hexa(methoxy)cyclotriphosphazene, 1,1,3,3,5,5-hexa(ethoxy)cyclotriphosphazene, 1,1,3,3,5,5-hexa(n-propoxy)cyclotriphosphazene, 1,1,3,3,5,5-hexa(iso-propoxy) cyclotriphosphazene, 1,1,3,3,5,5-hexa(n-butoxy) cyclotriphosphazene, 1,1,3,3,5,5-hexa(iso-butoxy) cyclotriphosphazene, 1,1,3,3,5,5-hexa(phenoxy) cyclotriphosphazene, 1,1,3,3,5,5-hexa(p-tolyloxy) cyclotriphosphazene, 1,1,3,3,5,5-hexa(m-tolyloxy) cyclotriphosphazene, 1,1,3,3,5,5-hexa(o-tolyloxy) cyclotriphosphazene, 1,1,3,3,5,5-hexa(p-anisyloxy) cyclotriphosphazene, 1,1,3,3,5,5-hexa(m-anisyloxy) cyclotriphosphazene, 1,1,3,3,5,5-hexa(o-anisyloxy) cyclotriphosphazene, 1,1,3,3,5,5-hexa(4-ethylphenoxy) cyclotriphosphazene, 1,1,3,3,5,5-hexa(4-n-propylphenoxy) cyclotriphosphazene, 1,1,3,3,5,5-hexa(4-iso-propylphenoxy)cyclotriphosphazene, 1,1,3,3,5,5-hexa(4-tert-butylphenoxy)cyclotriphosphazene, 1,1,3,3,5,5-hexa(4-tert-octylphenoxy)cyclotriphosphazene, 1,1,3,3,5,5-hexa(2,3-dimethylphenoxy)cyclotriphosphazene, 1,1,3,3,5,5-hexa(2,4-dimethylphenoxy)cyclotriphosphazene, 1,1,3,3,5,5-hexa(2,5-dimethylphenoxy)cyclotriphosphazene, 1,1,3,3,5,5-hexa(2,6-dimethylphenoxy)cyclotriphosphazene, 1,1,3,3,5,5-hexaaminocyclotriphosphazene, 1,1,3,3,5,5-hexa(4-phenylphenoxy)cyclotriphosphazene, 1,3,5-tris(methoxy)-1,3,5-tris(phenoxy)cyclotriphosphazene, 1,3,5-tris(ethoxy)-1,3,5-tris(phenoxy)cyclotriphosphazene, 1,3,5-tris(n-propoxy)-1,3,5-tris(phenoxy)cyclotriphosphazene, 1,3,5-tris(iso-propoxy)-1,3,5-tris(phenoxy)cyclotriphosphazene, 1,3,5-tris(n-butoxy)-1,3,5-tris(phenoxy)cyclotriphosphazene, 1,3,5-tris(iso-butoxy)-1,3,5-tris(phenoxy)cyclotriphosphazene, 1,3,5-tris(methoxy)-1,3,5-tris(p-tolyloxy)cyclotriphosphazene, 1,3,5-tris(methoxy)-1,3,5-tris(m-tolyloxy)cyclotriphosphazene, 1,3,5-tris(methoxy)-1,3,5-tris(o-tolyloxy)cyclotriphosphazene, 1,3,5-tris(methoxy)-1,3,5-tris(p-anisyloxy)cyclotriphosphazene, 1,3,5-tris(methoxy)-1,3,5-tris(m-anisyloxy)cyclotriphosphazene, 1,3,5-tris(methoxy)-1,3,5-tris(o-anisyloxy)cyclotriphosphazene, 1,3,5-tris(ethoxy)-1,3,5-tris(p-tolyloxy)cyclotriphosphazene, 1,3,5-tris(ethoxy)-1,3,5-tris(m-tolyloxy)cyclotriphosphazene, 1,3,5-tris(ethoxy)-1,3,5-tris(o-tolyloxy)cyclotriphosphazene, 1,3,5-tris(ethoxy)-1,3,5-tris(p-anisyloxy)cyclotriphosphazene, 1,3,5-tris(ethoxy)-1,3,5-tris(m-anisyloxy)cyclotriphosphazene, 1,3,5-tris(ethoxy)-1,3,5-tris(o-anisyloxy)cyclotriphosphazene, 1,3,5-tris(n-propoxy)-1,3,5-tris(p-tolyloxy)cyclotriphosphazene, 1,3,5-tris(n-propoxy)-1,3,5-tris(m-tolyloxy)cyclotriphosphazene, 1,3,5-tris(n-propoxy)-1,3,5-tris(o-tolyloxy)cyclotriphosphazene, 1,3,5-tris(n-propoxy)-1,3,5-tris(p-anisyloxy)cyclotriphosphazene, 1,3,5-tris(n-propoxy)-1,3,5-tris(m-anisyloxy)cyclotriphosphazene, 1,3,5-tris(n-propoxy)-1,3,5-tris(o-anisyloxy)cyclotriphosphazene, 1,3,5-tris(iso-propoxy)-1,3,5-tris(p-tolyloxy)cyclotriphosphazene, 1,3,5-tris(n-butoxy)-1,3,5-tris(p-tolyloxy)cyclotriphosphazene, 1,3,5-tris(iso-butoxy)-1,3,5-tris(p-tolyloxy)cyclotriphosphazene, 1,3,5-tris(methoxy)-1,3,5-tris(4-tert-butylphenoxy)cyclotriphosphazene, 1,3,5-tris(methoxy)-1,3,5-tris(4-tert-octylphenoxy)cyclotriphosphazene, 1,3,5-tris(n-propoxy)-1,3,5-tris(4-tert-butylphenoxy)cyclotriphosphazene, 1,3,5-tris(n-propoxy)-1,3,5-tris(4-tert-octylphenoxy)cyclotriphosphazene, 1,3,5-tris(methoxy)-1,3,5-tris(4-phenylphenoxy)cyclotriphosphazene, 1,3,5-tris(ethoxy)-1,3,5-tris(4-phenylphenoxy)cyclotriphosphazene, 1,3,5-tris(n-propoxy)-1,3,5-tris(4-phenylphenoxy)cyclotriphosphazene, 1,3,5-tris(iso-propoxy)-1,3,5-tris(4-phenylphenoxy)cyclotriphosphazene, 1,3,5-tris(n-butoxy)-1,3,5-tris(4-phenylphenoxy)cyclotriphosphazene, 1,3,5-tris(iso-butoxy)-1,3,5-tris(4-phenylphenoxy)cyclotriphosphazene, 1,1-diamino-3,3,5,5-tetrakis(methoxy)cyclotriphosphazene, 1,1-diamino-3,3,5,5-tetrakis(ethoxy)cyclotriphosphazene, 1,1-diamino-3,3,5,5-tetrakis(n-propoxy)cyclotriphosphazene, 1,1-diamino-3,3,5,5-tetrakis(iso-propoxy)cyclotriphosphazene, 1,1-diamino-3,3,5,5-tetrakis(n-butoxy)cyclotriphosphazene, 1,1-diamino-3,3,5,5-tetrakis(iso-butoxy)cyclotriphosphazene, 1,1-diamino-3,3,5,5-tetrakis(phenoxy)cyclotriphosphazene, 1,1-diamino-3,3,5,5-tetrakis(p-tolyloxy)cyclotriphosphazene, 1,1-diamino-3,3,5,5-tetrakis(m-tolyloxy)cyclotriphosphazene, 1,1-diamino-3,3,5,5-tetrakis(o-tolyloxy)cyclotriphosphazene, 1,1-diamino-3,3,5,5-tetrakis(p-anisyloxy)cyclotriphosphazene, 1,1-diamino-3,3,5,5-tetrakis(m-anisyloxy)cyclotriphosphazene, 1,1-diamino-3,3,5,5-tetrakis(o-anisyloxy)cyclotriphosphazene, and 1,1-diamino-3,3,5,5-tetrakis(4-phenylphenoxy)cyclotriphosphazene.

Examples of the linear phosphazene derivatives represented by the general formula (II) for the flame-resistant fiber of the present invention include 1,1,3,3,5,5-hexa(methoxy)triphosphazene, 1,1,3,3,5,5-hexa(ethoxy)triphosphazene, 1,1,3,3,5,5-hexa(n-propoxy)triphosphazene, 1,1,3,3,5,5-hexa(iso-propoxy)triphosphazene, 1,1,3,3,5,5-hexa(n-butoxy)triphosphazene, 1,1,3,3,5,5-hexa(iso-butoxy)triphosphazene, 1,1,3,3,5,5-hexa(phenoxy)triphosphazene, 1,1,3,3,5,5-hexa(p-tolyloxy)triphosphazene, 1,1,3,3,5,5-hexa(m-tolyloxy)triphosphazene, 1,1,3,3,5,5-hexa(o-tolyloxy)triphosphazene, 1,1,3,3,5,5-hexa(p-anisyloxy)triphosphazene, 1,1,3,3,5,5-hexa(m-anisyloxy)triphosphazene, 1,1,3,3,5,5-hexa(o-anisyloxy)triphosphazene, 1,1,3,3,5,5-hexa(4-ethylphenoxy)triphosphazene, 1,1,3,3,5,5-hexa(4-n-propylphenoxy)triphosphazene, 1,1,3,3,5,5-hexa(4-iso-propylphenoxy)triphosphazene, 1,1,3,3,5,5-hexa(4-tert-butylphenoxy)triphosphazene, 1,1,3,3,5,5-hexa(4-tert-octylphenoxy)triphosphazene, 1,1,3,3,5,5-hexa(2,3-dimethylphenoxy)triphosphazene, 1,1,3,3,5,5-hexa(2,4-dimethylphenoxy)triphosphazene, 1,1,3,3,5,5-hexa(2,5-dimethylphenoxy)triphosphazene, 1,1,3,3,5,5-hexa(2,6-dimethylphenoxy)triphosphazene, 1,1,3,3,5,5-hexaaminotriphosphazene, 1,1,3,3,5,5-hexa(4-phenylphenoxy)triphosphazene, 1,3,5-tris(methoxy)-1,3,5-tris(phenoxy)triphosphazene, 1,3,5-tris(ethoxy)-1,3,5-tris(phenoxy)triphosphazene, 1,3,5-tris(n-propoxy)-1,3,5-tris(phenoxy)triphosphazene, 1,3,5-tris(iso-propoxy)-1,3,5-tris(phenoxy)triphosphazene, 1,3,5-tris(n-butoxy)-1,3,5-tris(phenoxy)triphosphazene, 1,3,5-tris(iso-butoxy)-1,3,5-tris(phenoxy)triphosphazene, 1,3,5-tris(methoxy)-1,3,5-tris(p-tolyloxy)triphosphazene, 1,3,5-tris(methoxy)-1,3,5-tris(m-tolyloxy)triphosphazene, 1,3,5-tris(methoxy)-1,3,5-tris(o-tolyloxy)triphosphazene, 1,3,5-tris(methoxy)-1,3,5-tris(p-anisyloxy)triphosphazene, 1,3,5-tris(methoxy)-1,3,5-tris(m-anisyloxy)triphosphazene, 1,3,5-tris(methoxy)-1,3,5-tris(o-anisyloxy)triphosphazene, 1,3,5-tris(ethoxy)-1,3,5-tris(p-tolyloxy)triphosphazene, 1,3,5-tris(ethoxy)-1,3,5-tris(m-tolyloxy)triphosphazene, 1,3,5-tris(ethoxy)-1,3,5-tris(o-tolyloxy)triphosphazene, 1,3,5-tris(ethoxy)-1,3,5-tris(p-anisyloxy)triphosphazene, 1,3,5-tris(ethoxy)-1,3,5-tris(m-anisyloxy)triphosphazene, 1,3,5-tris(ethoxy)-1,3,5-tris(o-anisyloxy)triphosphazene, 1,3,5-tris(n-propoxy)-1,3,5-tris(p-tolyloxy)triphosphazene, 1,3,5-tris(n-propoxy)-1,3,5-tris(m-tolyloxy)triphosphazene, 1,3,5-tris(n-propoxy)-1,3,5-tris(o-tolyloxy)triphosphazene, 1,3,5-tris(n-propoxy)-1,3,5-tris(p-anisyloxy)triphosphazene, 1,3,5-tris(n-propoxy)-1,3,5-tris(m-anisyloxy)triphosphazene, 1,3,5-tris(n-propoxy)-1,3,5-tris(o-anisyloxy)triphosphazene, 1,3,5-tris(iso-propoxy)-1,3,5-tris(p-tolyloxy)triphosphazene, 1,3,5-tris(n-butoxy)-1,3,5-tris(p-tolyloxy)triphosphazene, 1,3,5-tris(iso-butoxy)-1,3,5-tris(p-tolyloxy)triphosphazene, 1,3,5-tris(methoxy)-1,3,5-tris(4-tert-butylphenoxy)triphosphazene, 1,3,5-tris(methoxy)-1,3,5-tris(4-tert-octylphenoxy)triphosphazene, 1,3,5-tris(n-propoxy)-1,3,5-tris(4-tert-butylphenoxy)triphosphazene, 1,3,5-tris(n-propoxy)-1,3,5-tris(4-tert-octylphenoxy)triphosphazene, 1,3,5-tris(methoxy)-1,3,5-tris(4-phenylphenoxy)triphosphazene, 1,3,5-tris(ethoxy)-1,3,5-tris(4-phenylphenoxy)triphosphazene, 1,3,5-tris(n-propoxy)-1,3,5-tris(4-phenylphenoxy)triphosphazene, 1,3,5-tris(iso-propoxy)-1,3,5-tris(4-phenylphenoxy)triphosphazene, 1,3,5-tris(n-butoxy)-1,3,5-tris(4-phenylphenoxy)triphosphazene, 1,3,5-tris(iso-butoxy)-1,3,5-tris(4-phenylphenoxy)triphosphazene, 1,1-diamino-3,3,5,5-tetrakis(methoxy)triphosphazene, 1,1-diamino-3,3,5,5-tetrakis(ethoxy)triphosphazene, 1,1-diamino-3,3,5,5-tetrakis(n-propoxy)triphosphazene, 1,1-diamino-3,3,5,5-tetrakis(iso-propoxy)triphosphazene, 1,1-diamino-3,3,5,5-tetrakis(n-butoxy)triphosphazene, 1,1-diamino-3,3,5,5-tetrakis(iso-butoxy)triphosphazene, 1,1-diamino-3,3,5,5-tetrakis(phenoxy)triphosphazene, 1,1-diamino-3,3,5,5-tetrakis(p-tolyloxy)triphosphazene, 1,1-diamino-3,3,5,5-tetrakis(m-tolyloxy)triphosphazene, 1,1-diamino-3,3,5,5-tetrakis(o-tolyloxy)triphosphazene, 1,1-diamino-3,3,5,5-tetrakis(p-anisyloxy)triphosphazene, 1,1-diamino-3,3,5,5-tetrakis(m-anisyloxy)triphosphazene, 1,1-diamino-3,3,5,5-tetrakis(o-anisyloxy)triphosphazene, and 1,1-diamino-3,3,5,5-tetrakis(4-phenylphenoxy)triphosphazene.

In another embodiment, the flame retardant compound comprises an organophosphorus or halogenated organophosphorus flame retardant. Preferably the organophosphorus and halogenated organophosphorus flame-retardants used may be any of various aromatic, aliphatic or cycloaliphatic compounds examples of which are Bis(2-chloroethyl)-2-chloroethylphosphonate (Mobil's Antiblaze-78), adducts of dimethyl methyl phosphonate and trimethylolpropane phosphite (e.g. Mobil's Antiblaze-19), triphenyl phosphate (Monsanto's TPP), Bis(beta-chloroethyl)vinylphosphonate (Stauffer's Fyrol Bis Beta), tri(β,β'-dichloroisopropyl)phosphate (Stauffer's Fyrol FR-2), isopropyl phenyl diphenyl phosphate (FMC's Kronitex-50) and the like.

In another embodiment, the flame retardant compound is a phosphorous/nitrogen flame retardant. Such compounds comprise reaction products of melamine with phosphoric acid or with condensed phosphoric acids, or comprise reaction products of condensates of melamine with phosphoric acid or with condensed phosphoric acids, or else comprise a mixture of the products. The reaction products with phosphoric acid or with condensed phosphoric acids are compounds which are produced via reaction of melamine or of the condensed melamine compounds such as melam, melem, or melon, etc., with phosphoric acid. Example of these are dimelamine phosphate, dimelamine pyrophosphate, melamine phosphate, melamine pyrophosphate, melamine polyphosphate, melam polyphosphate, melon polyphosphate, and melem polyphosphate, and mixed polysalts.

In addition to directly incorporating flame retardant compounds into the fibers that are used to form the fabric, alternatively, the flame retardant compounds can be surface applied to the yarn. The following is a list of flame retardant compounds that are well suited for surface application processes. In this embodiment, the one or more flame retardant compounds are contained in a bath through which the yarns or the fabric are fed. The solution or dispersion contained in the bath is pad applied to the yarns of the fabric. Once applied, the yarns or fabric are then heated in order to cure the finish.

In another embodiment, the one or more flame retardant compounds can be surface applied to the yarns or the fabric based on an exhaust procedure instead of a pad dip procedure.

It should be understood that a "finish" as used herein refers to a solution or dispersion that is surface applied to the yarns or fabric without forming a coating over the fabric. A coating, on the other hand, refers to a continuous film that can be adhered to the surface of a fabric. When surface applying flame retardant compounds, the compounds adhere to the surface of the yarn without forming a film over the surface of the fabric. This can also be achieved by exhausting the flame retardant compound.

In one embodiment, pentabromobenzylbromide (PBBBr) as described above may be surface applied to the fabric or yarns.

In another embodiment, the flame retardant compound surface applied to the yarns or the fabric comprises a brominated, organic aromatic or cyclic compound and a metallic oxide. Preferably, the brominated solid organic material is selected from the group consisting of polybrominated biphenyl, polybrominated biphenyl oxide, polybrominated benzene, polybrominated toluene, polybrominated chlorotoluene, polybrominated phenol, polybrominated aniline, polybrominated benzoic acid, tris phosphates of polybrominated phenols, polybrominated cyclopentane, polybrominated cyclohexane, polybrominated cyclooctane, polybrominated cyclodecane, polybrominated cyclododecane, hexachlorocyciopentadieno-dibromocyclooctane, or N,n'-ethyl-bis (dibromo-norbornene-dicarboximide). Preferably, the metallix oxide is selected from the group consisting of: Al, Ga, Si, Ge, As, Sb, Bi, Ti and Zr oxides.

In another embodiment, the flame retardant compound comprises an insoluble organic brominated compound such as tetrabromoorthochlorotoluene, hexabromobenzene, tris tribromophenyl phosphate, perbromopentacyclodecane, hexabromobiphenyl, polybrominated biphenyl, polybrominated biphenyl oxide, polybrominated benzene, polybrominated toluene, polybrominated chlorotoluene, polybrominated phenol, polybrominated aniline, tris phosphates of polybrominated phenols, polybrominated cyclopentane, polybrominated cyclohexane, polybrominated cyclooctane, polybrominated cyclodecane, polybrominated cyclododecane, hexachlorocyclopentadieno-dibromocyclooctane, or N,n'-ethyl-bis (dibromo-norbornene-dicarboximide).

In another embodiment, a brominated flame retardant compound containing the chemical compound

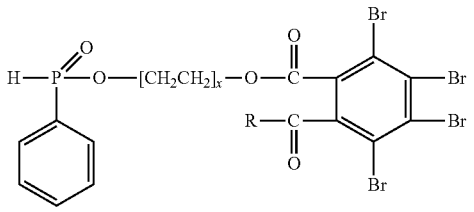

is used.

In another embodiment, the flame retardant compound comprises a water insoluble solid flame retardant, preferably hexabromocyclododecane which may preferably contain a second flame retardant compound such as antimony oxide.

In another embodiment, a phosphinic acid may be used as a flame retardant compound, such as acid esters made from phosphonic acids and dicarboxylic anhydrides.

In another embodiment, the flame retardant compound may comprise a cyclic phosphonate ester, such as tetrakis-(hydroxymethyl) phosphonium sulfate (THPS), tetrakis-(hydroxymethyl) phosphonium chloride (THPC), tetrakis-(hydroxymethyl) phosphonium oxalate or a methyl ester of phosphonic acid.

In another embodiment, the flame retardant compound comprises mono (2,3 dibromopropyl) phosphoric acid, a water-soluble cyclic nitrogen-containing polymerizable monomeric compound, and a catalytic amount of tetrakis (hydroxymethyl) phosphonium chloride. The water-soluble cyclic nitrogen-containing polymerizable monomeric compound may be selected from the group consisting of triazines, triazones, and cyclic alkylene ureas. Preferably the water-soluble cyclic nitrogen-containing polymerizable monomeric compound is trimethylolmelamine.

In yet another embodiment, the fire retardant compound comprises a dibromoneopentyl phosphate melamine salt, preferably a salt of 5,5-bis(bromomethyl)-2-hydroxy-2-oxo-1,3,2-dioxaphosphorinane.

In another embodiment, the flame retardant compound comprises a hydroxycarboxylic acid combined with certain metal oxides and hydroxides. Preferably the metal compound is selected from the group consisting of oxides and hydroxides of tin, antimony, aluminum and zinc. Preferably the hydroxycarboxylic acid's selected from the group consisting of malic acid, citric acid, tartaric acid, gallic acid, and 2,4-dihydroxybenzoic acid.

In yet another embodiment, the flame retardant compound is selected from the group consisting of bis(2,3-dibromopropyl)-3-bromo-2,2-bis(bromomethyl)propyl phosphate, bis (2,3-dibromopropyl)-3-chloro-2,2-bis(methyl)propyl phosphate, bis(2,3-dichloropropyl)-3-chloro-2,2-bis (chloromethyl)propylphosphate, and mixtures thereof.

In another embodiment, the flame retardant compound contains an inorganic flame retardant, preferably at least one phosphorus-containing flame retardant. Preferably the phosphorus-containing flame retardant is at least one selected from the group consisting of phosphoric acid and sodium salt derivatives thereof, phosphorous acid and sodium salt derivatives thereof, ammonium orthophosphate, ammonium hypophosphate, ammonium hydrogen phosphate, ammonium dihydrogen phosphate, ammonium hypophosphite, and ammonium dihydrogen orthophosphite. The inorganic flame retardant may comprise boric acid, sodium tetraborate and hydrates thereof, sodium metaborate and hydrates thereof, and zinc borate.

In another embodiment, the flame retardant compound includes at least one of a group of specified phosphoryl compounds which have a phenylene group.

Incorporating flame retardant compounds into fabrics made according to the present disclosure have resulted in fabrics having dramatically improved flame resistant properties. The present Inventor, further, unexpectedly discovered that the fire resistant properties of fabrics made to the present disclosure remain substantially intact even when the fabric is treated with a durable water resistant treatment and/or with a spectral reflectance agent. One skilled in the art, for instance, would expect that incorporating a durable water resistant treatment or a spectral reflectance agent into the fabric would significantly degrade the flame resistant properties. Incorporating higher concentrations of flame retardant compounds into the fabric, however, has resulted in the ability to incorporate water resistant treatments into the fabric and/or spectral reflectance agents into the fabric while maintaining the flame resistant properties of the fabric above desired levels.

Many different types of durable water resistant treatments may be applied to the fabric. In one embodiment, the durable water resistant treatment forms a finish (as opposed to a coating) on the fabric. The durable water resistant treatment can be applied to the fabric by treating the fabric with a bath containing the treatment, padding the composition into the fabric, placing the fabric on a tenter frame, and heating the fabric in order to evaporate all volatiles. During the process, the durable water resistant treatment may be applied to the fabric in an amount from about 0.5% to about 10% by weight, such as from about 1% to about 5% by weight.

In many applications, the durable water resistant treatment may comprise a fluoropolymer. Particular durable water resistant treatments that may be applied to the fabric in accordance with the present disclosure are discussed in greater detail below.

In one embodiment, the DWR comprises at least one member selected from the group consisting of a perfluoroalkyl group-containing substance, a fluorine-containing surfactant, a fluorine-containing oil, a fluorosilicone oil and a silicone oil. Preferably the fluorine-containing resin derives from an aqueous dispersion or dissolving in a solvent. Preferably, the fluorine-containing resin comprises a fluororesin or a mixture of a fluororesin and some other resin. Preferably, the fluororesin is a copolymer of a fluoroolefin and a vinyl monomer. Preferably, the fluororesin is a copolymer of fluoroolefins. Preferably, the copolymer of fluoroolefins is a copolymer of vinylidene fluoride and a fluoroolefin other than vinylidene fluoride.

In another embodiment, a durable water/soil-resistant fluoropolymer is selected from those groups that will provide the necessary water/soil resistance and can be polymerized. Examples include fluorinated monomers of acrylates, methacrylates, alkenes, alkenyl ethers, styrenes, and the like. Monomers that contain carbon-fluorine bonds that are useful include, but are not limited to, Zonyl TA-N(an acrylate from DuPont), Zonyl™ (a methacrylate from DuPont), FX-13 (an acrylate from 3M), and FX-14 (a methacrylate from 3M) or UNIDYNE TG581 (a $C_6$ fluoropolymer available from Daikin). The fluoropolymers may include —CF 3 and —CHF 2 end groups, perfluoroisopropoxy groups (—OCF(CF 3) 2), 3,3,3-trifluoropropyl groups, and the like. The polymers may include vinyl ethers having perfluorinated or partially fluorinated alkyl chains. The fluoropolymer preferably comprises one or more fluoroaliphatic radical-containing monomers. Monomers used to form the fluoropolymer may be based upon 6 carbon chain chemistry or 8 carbon chain chemistry.

In another embodiment, the DWR comprises a repellent and a fluorine-containing resin, wherein the repellent comprises an esterification reaction product (I-3) from a perfluoroalkyl group-containing compound (I-3-1) and a compound (I-3-2) containing a phosphoric acid group as a functional group, and the fluorine-containing resin derives from an aqueous dispersion. Preferably, the fluorine-containing resin comprises a fluororesin or a mixture of a fluororesin and some other resin. Preferably, the other resin is an acrylic resin. Preferably, the fluororesin is a copolymer of a fluoroolefin and a vinyl monomer. Preferably, the fluororesin is a copolymer of fluoroolefins. Preferably, the copolymer of fluoroolefins is a copolymer of vinylidene fluoride and a fluoroolefin other than vinylidene fluoride. Preferably, the fluorine-containing resin comprises a fluororesin obtained by seed polymerization of an acrylic resin.

Commercially available DWR not mentioned above that may be used in the present disclosure include fluoropolymer compositions sold under the name MILEASE® by Clariant, fluorochemicals sold under the tradename TEFLON® or Capstone® by DuPont, fluorochemicals sold under the by tradename ZEPEL® also by DuPont, or fluorocarbon polymers sold under the tradename REPEARL® by the Mitsubishi Chemical Company or fluorocarbon polymers sold under the tradename UNIDYNE® by the Daikin Company.

In one embodiment, if desired, an isocyanate may be present in conjunction with a fluorochemical, such as a fluoropolymer. The isocyanate may comprise a blocked isocyanate that is a formaldehyde-free cross-linking agent for fluorochemical finishes. The blocking agent may comprise a phenol or any other suitable constituent.

Once applied to the fabric as described above, the fabric can possess excellent water resistant properties. For example, fabrics may have a spray rating according to AATCC spray test method 22-1996 of at least about 90, such as a spray rating of 100 even after 25 laundry cycles. When tested according to the Dynamic Water Absorption test (AATCC test method No. 70-1997) the fabric can have a Dynamic Water Absorption rating after 25 laundry cycles of less than about 15%, such as less than about 12%, such as even less than about 10%. The water permeability of the fabric can be about 36 cm, such as from about 10 cm to about 100 cm according to test method no. AATCC 127.

Incorporating fluoropolymers into fabrics typically degrades the flame resistant properties of fabrics. The present Inventor discovered, however, that even after being treated with a durable water resistant treatment, fabrics made according to the present disclosure can have, when tested according ASTM D-6413, a char length of less than about 6 inches, such as less than about 5.5 inches, and an after flame of less than about 2 seconds and may produce no drips during the flame test, even after being laundered 25 laundry cycles.

In addition to durable water resistant treatments, a spectral reflectance agent such as carbon black, can be incorporated into the fibers and/or surface applied to the yarns. The spectral reflectance agent changes the reflectance properties of the fabric over a certain wave length range that renders the fabric harder to detect when viewed through devices such as night vision goggles. Unfortunately, incorporating carbon particles into fabrics using conventional pad applications with binders can adversely affect the fire resistant properties of the fabric. The present Inventor has discovered, however, that spectral reflectance agents can be incorporated into fabrics made according to the present disclosure while maintaining the flame resistant properties of the fabric above desired levels.

In one embodiment, for instance, the spectral reflectance agent may comprise carbon black and may be contained in the fibers in the amount from about 1000 ppm to about 20,000 ppm, such as from about 3000 ppm to about 10,000 ppm. The carbon black particles may be incorporated into the polyester and/or nylon fibers in an amount sufficient for the fibers to have a nIR reflectance at a wave length from about 600 nm to about 900 nm, with suppression from about 20% to about 80%.

When incorporated into the fabric, the carbon black particles can be contained in all the yarns or in only selected yarns. For example, in one embodiment, only the warp yarns or only the weft yarns include the carbon particles.

In order to further improve the camouflage-like properties of the fabric, in addition to incorporating a spectral reflectance agent into the fibers, the fabric can be dyed or printed with any suitable background color. For example, when used in desert-like environments, the fabric can be dyed a light brown or sand color. When used in more tropical environments, however, the fabric may be dyed a shade of green. Any suitable dyes for application to polyamide and/or polyester fabrics may be used.

As described above, a spectral reflectance agent can be incorporated into the fabrics without substantially compromising the flame resistant properties of material. For instance, even after incorporating the spectral reflectance agent into the fibers, the fabric, when tested according to the ASTM test No. D-6413, may display a char length of less than about 6 inches, such as less than about 5.5 inches, may have an after flame of less than about 2 seconds and may not produce any drips during the test even after being laundered 25 laundry cycles.

In one embodiment, a spectral reflectance agent can be incorporated into the fabric and the fabric can then be dyed and printed with a camouflage pattern. The camouflage pattern may vary depending upon various factors including the environment into which the garment is to be worn. The camouflage pattern may include predominantly beige colors when used in desert areas, predominantly gray areas for use in urban areas, or predominantly green colors for use in woodland areas. Camouflage patterns are intended to provide protection not only in the visible light spectrum but also in the infrared spectrum.

The fabric can be dyed and printed using traditional textile dyes and pigments made from disperse, acid and basic dyes. Printing can be done using, for instance, screen printing machines. If the fabric contains significant amounts of polyester, disperse dyeing and printing can be carried out. If the fabric contains a significant amount of polyamide, on the other hand, basic dyes/pigments may be used.

In applying print patterns to fabrics, typically a binder is used in the dye, in the print composition or as a separate treatment. The binder, however, generally contains carbon in an amount that can adversely interfere with the fire resistant properties of the fabric. By incorporating a spectral reflectance agent into the fibers as described above, however, fabrics made in accordance with the present invention can be printed with a camouflage pattern using minimal binder. For instance, no binder may be required at all when creating a camouflage pattern that predominantly includes desert colors, such as beige colors. When applying darker colors to the fabric, on the other hand, the binder may be present in the composition applied to the fabric at levels of less than 50%, such as less than 40%, such as less than 30%, such as less than 20%, such as even less than 10% by weight.

Fabrics constructed in accordance with the present disclosure can be used to construct numerous different types of products for use in various applications. In one embodiment, for instance, the fabrics can be used to produce clothing articles. Due to the improved flame resistant properties, the fabrics are particularly well suited for constructing military garments, garments worn by firefighters and other security personnel, and garments worn in industrial settings. Garments made according to the present disclosure may include shirts, pants, bib overalls, socks and other leg wear, gloves, scarves, hats, face shields, shoes, and the like.

For exemplary purposes only, referring to FIG. 1, one embodiment of an article of clothing 10 made in accordance with the present disclosure is shown. In this embodiment, the article of clothing comprises a jacket, such as a flight jacket. The flight jacket 10 includes an inner lining 12 adapted to face the wearer, and an outer shell 14. Fabrics made according to the present disclosure can be used to construct the outer shell 14, the inner lining 12, or both. In one embodiment, for instance, the outer shell 14 and the inner lining 12 may both be comprised of fabrics made according to the present disclosure.

Depending upon the particular application and the environment in which the jacket 10 is intended to be worn, the jacket 10 can further include various inner layers of material. For instance, in one embodiment, the jacket 10 can include multiple layers of material that together comprise a composite fabric product.

For example, referring to FIG. 2, a cross-section of the jacket 10 illustrated in FIG. 1 is shown. In this embodiment, the composite fabric product contains five different layers. It should be understood, however, that the composite fabric product may contain more or less than five layers and that the product shown in FIG. 2 is merely exemplary. For instance, as shown in FIG. 2, in addition to the inner lining 12 and the outer shell 14, the jacket 10 includes a fill layer 16, a first middle or barrier layer 18 and a second middle or barrier layer 20. The barrier layers 18 and 20, for instance, may comprise additional thermal barrier layers.

As described above, the outer shell 14 can comprise a fabric made in accordance with the present disclosure. The inner lining 12 can also comprise a fabric made in accordance with the present disclosure. Alternatively, the inner lining may comprise a woven or knitted fabric comprised of inherent flame resistant fibers. For instance, in one embodiment, the inner lining 12 may comprise a chambray fabric, which is comprised of a closely woven plain weave fabric that is relatively lightweight. The chambray fabric, for instance, can be constructed from aramid fibers, such as meta-aramid fibers. In one embodiment, for instance, the chambray fabric may be made exclusively from meta-aramid NOMEX fibers.

The fill layer 16 may comprise an insulative nonwoven material made from relatively high loft fibers. The fill layer 16 may be used in order to increase the warmth of the jacket, especially when worn in a cold environment. The high loft fibers may comprise, for instance, para-aramid fibers, meta-aramid fibers, cellulosic fibers such as cotton or rayon, acrylic fibers such as modacrylic fibers, nylon fibers, polyester fibers, and mixtures thereof. In one embodiment, for instance, aramid fibers and/or FR cotton or rayon fibers may be combined with from about 30% to about 40% by weight polyester fibers.

If desired, the fill layer 16 may be treated with one or more flame retardant compounds as described above. In addition, the fill layer may also be treated with one or more durable water resistant treatments as described above. The loft layer can have a basis weight of from about 1.8 oz/yd$^2$ to about 6 oz/yd$^2$, such as from about 2.0 oz/yd$^2$ to about 5.5 oz/yd$^2$. The loft layer is also characterized by its insulative properties or Clo value which may range from about 1.0 to about 5.0, such as from about 1.5 to about 3.5 (1 Clo=0.155 m$^2$k/w).

In one embodiment, the fill layer 16 may be comprised of synthetic fibers such as polyester fibers that have not been treated with a flame retardant compound but have been treated with a durable water resistant treatment. Alternatively, the fill layer 16 may contain polyester fibers treated with a fire resistant compound with or without a durable water resistant treatment. When treated with a fire retardant compound, for instance, the polyester fibers may contain phosphorus at a concentration of from about 2000 ppm to about 7000 ppm, such as from about 3000 ppm to about 5000 ppm. In still other embodiments, the fill layer may contain Basofil fibers and/or FR Lenzing fibers.

As described above, the fill layer generally comprises a high loft nonwoven material. The fill layer can be constructed using cross lapped or vertical lapped techniques.

As shown in FIG. 2, the fabric composite product can also include one or more middle or barrier layers 18 and/or 20. In one embodiment, for instance, the middle layer 18 may comprise a thermal barrier layer that provides additional protection to the wearer from flash fires. For instance, in one embodiment, the middle layer 18 may comprise a base layer, such as a nonwoven web hydroentangled with other fibers, such as a spunlaced web. The nonwoven web may comprise, for instance, a spunbond layer or a meltblown layer. If desired, the nonwoven web can be apertured, which is also referred to as needled, so as to contain from about 10 holes to about 300 holes per square inch.

The base layer may be comprised of para-aramid fibers, meta-aramid fibers, or a blend thereof. The middle or barrier layer may contain exclusively para-aramid fibers and/or meta-aramid fibers or may contain inherently flame resistant fibers combined with other fibers. For instance, the layer may contain cellulosic fibers such as cotton or rayon fibers, acrylic fibers such as monoacrylic fibers, nylon fibers, polyester fibers, or blends thereof. Any of the non-inherently flame resistant fibers may be treated with a flame retardant compound. For instance, in one embodiment, the aramid fibers may be blended with FR Lenzing fibers.

The weight of the layer can range from about 0.40 oz/yd$^2$ to about 4.0 oz/yd$^2$, such as from about 0.5 oz/yd$^2$ to about 2.0 oz/yd$^2$.

If desired, the middle layer 18 may be further treated with one or more fire retardant compounds as described above and/or with one of more durable water resistant treatments as described above.

In addition to middle layer 18, the composite fabric product can also include other middle layers, such as middle layer 20, as shown in FIG. 2. Middle layer 20 can generally have the same construction as middle layer 18 as described above. In various embodiments, the composite fabric product may only include middle layer 18, may only include middle layer 20, or, as shown in FIG. 2, may include both middle layers.

In fact, it should be appreciated that any of the layers of the composite product shown in FIG. 2 may be removed. For instance, in one embodiment, a garment can be made in accordance with the present disclosure that only includes the outer shell fabric 14. In another embodiment, the composite fabric product may only contain an outer shell and an inner lining. In still another embodiment, the fabric product may contain only a single middle layer positioned in between the outer shell fabric and the inner lining. The middle layer, for instance, may comprise the high loft layer or may comprise a thermal barrier layer.

Referring to FIG. 3, still another embodiment of a composite fabric product in accordance with the present disclosure is shown. Like reference numerals have been used to indicate similar elements. For instance, the composite fabric product includes an inner lining 12 and an outer shell 14. In addition, the composite fabric product can include zero to three middle layers, such as fill layer 16, a first middle or barrier layer 18, and a second middle or barrier layer 20.

In the embodiment illustrated in FIG. 3, the composite fabric product further includes a film 22 that has been laminated to the outer shell fabric 14. The film 22 may comprise, for instance, a polyurethane film, such as a fire resistant polyurethane film. In an alternative embodiment, the film 22 may comprise polytetrafluoroethylene. For instance, in one embodiment, an expanded polytetrafluoroethylene (ePTFE) may be used.

The film layer 22 may be adhered to the outer shell 14 using any suitable technique or method. In one embodiment, for instance, an FR adhesive may be used to laminate the film to the fabric.

By incorporating the film layer 22 into the composite fabric product, the outer shell 14 not only becomes water resistant but also waterproof. In exchange, the breathability of the outer shell may be reduced. For instance, the breathability may be from about 400 g/m$^2$/24 hrs to about 600 g/m$^2$/24 hrs.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed is:

1. A flame resistant article of clothing comprising;

a garment having a shape and size configured to cover a portion of a wearer's body, the garment comprising a woven or knitted fabric constructed from yarn, the yarns being comprised of synthetic fibers comprising a polymer comprising a polyester, a non-aramid polyamide, or a mixture thereof, the fabric containing a first flame retardant compound and a second flame retardant compound, the first flame retardant compound being mixed with the polymer to form the fibers and wherein the first flame retardant is mixed at a concentration of from about 4000 ppm to 8000 ppm, the second flame retardant compound having been surface applied to the yarn at a concentration of from about 7000 ppm to about 25,000 ppm, wherein the first flame retardant compound, the second flame retardant compound, or a combination thereof comprise a phosphorus containing compound or a halogen containing compound, and wherein the fabric when tested according to ASTM test No. D-6413 exhibits an after flame of less than about 2 seconds.

2. An article of clothing as defined in claim 1, wherein the halogen containing compound is a bromine compound, wherein the first flame retardant compound is a phosphorous compound or a bromine compound and wherein the second flame retardant compound is also a phosphorous compound or a bromine compound.

3. An article of clothing as defined in claim 1, wherein the first flame retardant compound is the same as the second flame retardant compound.

4. An article of clothing as defined in claim 1, wherein the total concentration of flame retardant compounds contained in the fabric is from about 10,000 ppm to about 50,000 ppm.

5. An article of clothing as defined in claim 1, wherein the yarns comprise air jet textured yarns.

6. An article of clothing as defined in claim 1, wherein the yarns comprise false twist textured yarns.

7. An article of clothing as defined in claim 1, wherein the yarns have a denier of from about 20 to about 1000.

8. An article of clothing as defined in claim 1, wherein the fabric has an air porosity of less than about 5 cfm/ft$^2$.

9. An article of clothing as defined in claim 1, wherein the fabric has a basis weight of from about 1 oz/yd$^2$ to about 5 oz/yd$^2$.

10. An article of clothing as defined in claim 1, wherein the garment defines an interior surface that faces a wearer and an exterior surface and wherein the fabric forms the exterior surface.

11. An article of clothing as defined in claim 1, wherein the garment is made from a composite fabric product that includes an outer shell and a liner, the fabric comprising the liner.

12. An article of clothing as defined in claim 11, wherein the outer shell also comprises a woven or knitted fabric constructed from yarns that are comprised of synthetic fibers, the synthetic fibers comprising a polymer comprising a polyester, a non-aramid polyimide, or a mixtures thereof, the outer shell fabric also containing a first flame retardant compound and a second flame retardant compound, the first flame retardant compound being mixed with the polymer to form the fibers, the second flame retardant compound having been surface applied to the yarns, the outer shell having a total flame retardant compound concentration of at least about 10,000 ppm.

13. An article of clothing as defined in claim 11, wherein the composite fabric product further includes a film layer laminated to the outer shell.

14. An article of clothing as defined in claim 13, wherein the film layer comprises a polyurethane polymer or a polytetrafluoroethylene polymer.

15. An article of clothing as defined in claim 1, wherein the garment is made from a composite fabric product, the composite fabric product including an outer shell, a liner, and a middle layer positioned in between the outer shell and the liner, the middle layer comprising an apertured hydroentangled web.

16. An article of clothing as defined in claim 15, wherein the composite fabric product further includes a filling layer also positioned in between the outer shell and the liner, the filling layer comprising a nonwoven loft material.

17. An article of clothing as defined in claim 16, wherein the nonwoven loft material further comprises a durable water resistant treatment, a flame retardant compound, or both.

18. An article of clothing as defined in claim 16, wherein the filling layer has a basis weight of from about 2 oz/yd$^2$ to about 6 oz/yd$^2$ and has a Clo value of from about 1 to about 5, the middle layer having a basis weight of from about 0.4 oz/yd$^2$ to about 2 oz/yd$^2$.

19. An article of clothing as defined in claim 1, wherein the fabric further contain carbon black in the amount from about 0.1% to about 2% by weight, the carbon black being present in the fabric such that the fabric has an IR reflectance at a wave length of from about 600 nm to about 1200 nm of from about 20% to about 80%.

20. An article of clothing as defined in claim 19, wherein the fabric has been treated with a durable water resistant treatment.

21. An article of clothing as defined in claim 19, wherein the fabric when tested according to ASTM test No. D-6413 exhibits a char length of less than about 6 inches in at least one direction and has an after flame of less than about 2 seconds.

22. An article of clothing as defined in claim 1, wherein the fabric has been treated with a durable water resistant treatment.

23. An article of clothing as defined in claim 22, wherein the fabric when tested according to ASTM test No. D-6413 exhibits a char length of less than about 6 inches in at least one direction and has an after flame of less than about 2 seconds.

24. An article of clothing as defined in claim 1, wherein the fabric when tested according to ASTM test No. D-6413 exhibits a char length of less than about 6 inches in at least one direction.

25. An article of clothing as defined in claim 24, wherein the fabric does not contain any aramid fibers.

26. An article of clothing as defined in claim 1, wherein the fabric has a moisture vapor transmission rate of greater than about 600 g/m$^2$/24 hrs.

27. An article of clothing as defined in claim 1, wherein the woven or knitted fabric defines an exterior surface of the garment, the exterior surface including a printed camouflage pattern.

28. An article of clothing as defined in claim 1, wherein the woven or knitted fabric further comprises stretch yarns, the fabric having at least 10% stretch in at least one direction.

29. An article of clothing as defined in claim 1, wherein the synthetic fibers comprise polyester fibers and non-aramid polyamide fibers and wherein the second flame retardant compound is surface applied to the yarn at a concentration of from about 7000 ppm to about 20,000 ppm.

30. An article of clothing as defined in claim 1, wherein the first flame retardant compound comprises only a phosphorus containing compound.

31. An article of clothing as defined in claim 1, wherein the polymer comprises a non-aramid polyamide.

32. An article of clothing as defined in claim 1, wherein the first flame retardant is mixed at a concentration of from about 6000 ppm to about 8000 ppm.

33. A flame resistant fabric comprising;

a woven or knitted fabric constructed from yarns, the yarns being comprised of synthetic fibers comprising a polymer comprising a polyester, a non-aramid polyamide, or a mixtures thereof, the fabric containing a first flame retardant compound and a second flame retardant compound, the first flame retardant compound being mixed with the polymer to form the fibers and wherein the first flame retardant is mixed at a concentration of from about 4000 ppm to 8000 ppm, the second flame retardant compound having been surface applied to the yarn at a concentration of from about 7000 ppm to about 25,000 ppm, wherein the first flame retardant compound, the second flame retardant compound, or a combination thereof comprise a phosphorus containing compound or a halogen containing compound, the fabric having been treated with a durable water resistant treatment, the fabric having a basis weight of from about 2 oz/yd$^2$ to about 5 oz/yd$^2$, and wherein when subjected to ASTM test No. D-6413, the fabric producing a char length of less than about 6 inches in at least one direction and having an after flame of less than about 2 seconds.

34. A fabric as defined in claim 33, wherein the synthetic fibers further comprise carbon black, carbon black being present in the fabric in the amount sufficient for the fabric to have an IR reflectance at a wave length of from about 600 nm to about 1200 nm from about 20% to about 80%.

35. A composite fabric product comprising:

an outer shell comprising a woven or knitted fabric constructed from yarns, the yarns being comprised of synthetic fibers comprising a polymer comprising a polyester, a non-aramid polyimide, or a mixtures thereof, the fabric containing a first flame retardant compound and a second flame retardant compound, the first flame retardant compound being mixed with the polymer to form the fibers and wherein the first flame retardant is mixed at a concentration of from about 4000 ppm to 8000 ppm, the second flame retardant compound having been surface applied to the yarn at a concentration of from about 7000 ppm to about 25,000 ppm, wherein the first flame retardant compound, the second flame retardant compound, or a combination thereof comprise a phosphorus containing compound or a halogen containing compound, the fabric having been treated with a durable water resistant treatment, the fabric having a basis weight of from about 2 oz/yd$^2$ to about 5 oz/yd$^2$, the fabric having an air permeability of less than about 20 cfm/ft$^2$ and having a moisture transmission rate of at least about 600 g/m$^2$/24 hrs, and wherein when subjected to ASTM test No. D-6413, the fabric producing a char length of less than about 6 inches in at least one direction and having an after flame of less than about 2 seconds;

a liner; and at least one middle layer positioned in between the outer shell and the liner, the middle layer comprising a hydroentangled web or a lapped web.

36. A composite fabric product as defined in claim 35, wherein the middle layer comprises the lapped web and has a basis weight of from about 1 oz/yd$^2$ to about 12 oz/yd$^2$ and has a Clo value of from about 1 to about 5.

37. A composite fabric product as defined in claim 36, wherein the lapped web that comprises the middle layer comprises synthetic fibers comprising a polyester, the middle layer having been treated with a durable water resistant treatment.

38. A composite fabric product as defined in claim 37, wherein the synthetic fibers comprising a polyester have been treated with a flame retardant compound.

39. A composite fabric product as defined in claim 36, wherein the product further contains a second middle layer, the second middle layer comprising a hydroentangled web containing inherently flame resistant fibers, the second middle layer having a basis weight of from about 0.4 oz/yd$^2$ to about 4 oz/yd$^2$.

40. A composite fabric product as defined in claim 39, wherein the product further comprises a third middle layer, the third middle layer also comprising a hydroentangled web containing inherently flame resistant fibers, the third middle layer having a basis weight of from about 0.4 oz/yd$^2$ to about 4 oz/yd$^2$, the middle layer comprising the lapped web being positioned in between the second middle layer and the third middle layer.

41. A composite fabric product as defined in claim 35, wherein the middle layer comprises the hydroentangled web and has a basis weight of from about 0.4 oz/yd$^2$ to about 4 oz/yd$^2$.

42. A composite fabric product as defined in claim 41, wherein the middle layer has been needle punched.

43. A composite fabric product as defined in claim 35, wherein the liner comprises a chambray fabric containing aramid fibers.

44. A composite fabric product as defined in claim 35, further comprising a film layer laminated to the outer shell, the film layer comprising a polyurethane polymer or a polytetrafluoroethylene polymer.

* * * * *